US011388519B2

(12) United States Patent
Yang et al.

(10) Patent No.: US 11,388,519 B2
(45) Date of Patent: Jul. 12, 2022

(54) SPEAKER, TERMINAL, AND SPEAKER CONTROL METHOD

(71) Applicant: Honor Device Co., Ltd., Shenzhen (CN)

(72) Inventors: Xiao Yang, Beijing (CN); Ligang Yu, Beijing (CN); Fang-Ching Lee, Shenzhen (CN)

(73) Assignee: HONOR DEVICE CO., LTD., Shenzhen (CN)

( * ) Notice: Subject to any disclaimer, the term of this patent is extended or adjusted under 35 U.S.C. 154(b) by 0 days.

(21) Appl. No.: 17/040,324

(22) PCT Filed: Apr. 3, 2018

(86) PCT No.: PCT/CN2018/081773
§ 371 (c)(1),
(2) Date: Sep. 22, 2020

(87) PCT Pub. No.: WO2019/191910
PCT Pub. Date: Oct. 10, 2019

(65) Prior Publication Data

US 2021/0021934 A1 Jan. 21, 2021

(51) Int. Cl.
*H04R 9/02* (2006.01)
*H04R 9/06* (2006.01)

(52) U.S. Cl.
CPC ..... *H04R 9/025* (2013.01); *H04R 9/06* (2013.01); *H04R 2201/028* (2013.01); *H04R 2201/029* (2013.01); *H04R 2499/11* (2013.01); *H04R 2499/15* (2013.01)

(58) Field of Classification Search
CPC .... H04R 9/025; H04R 9/06; H04R 2201/028; H04R 2201/029; H04R 2499/11; H04R 2499/15
See application file for complete search history.

(56) References Cited

U.S. PATENT DOCUMENTS 6,243,472 B1 * 6/2001 Bilan ..... H04R 1/06 381/407
9,100,759 B2 8/2015 Citerin
9,807,502 B1 10/2017 Hatab et al.
2009/0285439 A1 * 11/2009 Yuasa ..... H04R 1/06 381/412
2015/0124982 A1 * 5/2015 Berthelsen ..... H04R 29/001 381/59

(Continued)

FOREIGN PATENT DOCUMENTS

CN 1291067 A 4/2001
CN 103108270 A 5/2013

(Continued)

*Primary Examiner* — Alexander Krzystan
*Assistant Examiner* — Julie X Dang
(74) *Attorney, Agent, or Firm* — Slater Matsil, LLP

(57) ABSTRACT

A speaker includes a front cover, a coil, a frame, a magnet, a magnetic diaphragm, and a voice coil. The coil is located on an inner side of the front cover, the magnetic diaphragm is located between the coil and the voice coil, a periphery of the magnetic diaphragm is adhered to one side of the frame, the magnet is located on the other side of the frame, and the one side and the other side of the frame are two opposite sides of the frame. The voice coil is configured to drive the magnetic diaphragm to vibrate.

17 Claims, 10 Drawing Sheets

(56) References Cited

U.S. PATENT DOCUMENTS

| | | | | |
|---|---|---|---|---|
| 2017/0303044 | A1 | 10/2017 | Sterling | |
| 2019/0052973 | A1* | 2/2019 | Yuen | H04R 7/127 |
| 2020/0336850 | A1* | 10/2020 | Asfaw | H04R 29/003 |

FOREIGN PATENT DOCUMENTS

| | | | |
|---|---|---|---|
| CN | 104618838 | A | 5/2015 |
| CN | 105530586 | A | 4/2016 |
| CN | 105792076 | A | 7/2016 |
| CN | 106454679 | A | 2/2017 |
| CN | 107396275 | A | 11/2017 |
| EP | 2408219 | A1 | 1/2012 |
| GB | 2499026 | A | 8/2013 |
| WO | 2016135010 | A1 | 9/2016 |

* cited by examiner

SPEAKER, TERMINAL, AND SPEAKER CONTROL METHOD

CROSS-REFERENCE TO RELATED APPLICATIONS

This application is a national stage of International Application No. PCT/CN2018/081773, filed on Apr. 3, 2018, which is hereby incorporated by reference in its entirety.

TECHNICAL FIELD

This application relates to the field of acoustic technologies, and in particular, to a speaker, a terminal, and a speaker control method.

BACKGROUND

Currently, in mobile terminals such as a mobile phone and a tablet, a miniature speaker is usually used to output a sound. A core element that is of the miniature speaker and that is used to generate sound is a speaker. Common speakers may be classified into a moving coil speaker, a balanced armature speaker, a flat panel speaker, and the like according to different sound-making principles of the speakers. Currently, a common miniature speaker of the mobile terminal usually makes a sound by using the moving coil speaker. For a common structure of the moving coil speaker, refer to FIG. 1. The moving coil speaker includes a diaphragm 01, a voice coil 02 connected to the diaphragm 01, a magnet 03 disposed on a side of the diaphragm 01, and a frame 04 used to install the diaphragm 01 and the magnetic piece 03. After being powered on, the voice coil 02 generates an induced magnetic field, and therefore is shifted due to an action of a magnetic force of the magnet 03, to drive the diaphragm 01 to vibrate. When the diaphragm 01 vibrates, air in front of the diaphragm 01 is pushed to generate a sound wave.

A mobile device (for example, a mobile phone or a tablet) usually has at least one speaker used to convert an electrical signal such as music or a voice back into a sound. However, a speaker used for the mobile device has a limited size and a relatively thin thickness (usually 2.5 mm to 3 mm). Therefore, an effective area of a diaphragm of the speaker is relatively small, and an amplitude is also very small when the diaphragm vibrates. Consequently, air that can be pushed by the diaphragm is limited, and therefore, a volume of sound that can be emitted is relatively low, and has insufficient bass. Because of the pursuit of ultrathin, ultralight and portable mobile device, an internal design of the mobile device is very compact, and space that can be used for the speaker and a rear cavity of the speaker is difficult to increase. Therefore, in the prior art, when a size of a speaker remains unchanged, a volume and bass are increased by increasing a gain of an audio amplifier integrated circuit. However, because amplitude values of voice and music signals are variable and change in a relatively large range, and cannot be predicted in advance, increasing the gain of the audio amplifier integrated circuit easily causes overheating and an excessively large amplitude of the speaker when the speaker works, thereby causing damage to the speaker.

SUMMARY

Embodiments of this application provide a speaker, a terminal, and a speaker control method, to resolve a problem that the speaker is damaged due to an increase in a gain of an audio amplifier integrated circuit.

According to a first aspect, an embodiment of this application provides a speaker, including a front cover, a coil, a frame, a magnet, a magnetic diaphragm, and a voice coil. The coil is located on an inner side of the front cover, the magnetic diaphragm is located between the coil and the voice coil, a periphery of the magnetic diaphragm is adhered to one side of the frame, the magnet is located on the other side of the frame, and the one side of the frame and the other side are two opposite sides of the frame. The voice coil may drive the magnetic diaphragm to vibrate.

In this case, the voice coil drives the magnetic diaphragm to vibrate forward and backward, causing a change in a relative distance between the magnetic diaphragm and the coil.

The magnetic diaphragm forms an "iron core" that can change inductance of the coil. Therefore, an inductance value of the coil changes with vibration of the magnetic diaphragm.

In a possible implementation, the magnetic diaphragm may include a diaphragm and a magnetic conductive material coated on a surface of the diaphragm. In this case, the magnetic conductive material exists on the surface of the diaphragm, and therefore the "iron core" that may enable the coil to generate inductance is formed.

In a possible implementation, the speaker further includes an audio amplifier integrated circuit, a lead of the voice coil is welded to a solder pad at the bottom of the frame, a lead of the coil is welded to the solder pad, and the solder pad is electrically connected to the audio amplifier integrated circuit.

In a possible implementation, leads at two ends of the voice coil are welded to the solder pad at the bottom of the frame, and a lead groove is further disposed on the front cover and the frame of the speaker. In this case, the lead of the coil may also be welded to the solder pad through the lead groove. The solder pad is electrically connected to the audio amplifier integrated circuit, and the audio amplifier integrated circuit may be connected to the voice coil and the coil. Therefore, the audio amplifier integrated circuit may obtain, through measurement, the inductance value of the coil and a voltage or current of the voice coil, to calculate an adjusted driver voltage or driver current of the voice coil.

According to a second aspect, an embodiment of this application provides a terminal, including a speaker and an audio amplifier integrated circuit. The speaker includes a coil, a magnetic diaphragm, and a voice coil; the audio amplifier integrated circuit is connected to the voice coil and the coil, and is configured to: measure voltages or currents at two ends of the voice coil, measure inductance value at two ends of the coil, and determine a driver voltage or driver current of the voice coil based on the inductance value and the voltage or current; and the voice coil is configured to drive, based on the driver voltage or driver current, the magnetic diaphragm to vibrate.

That the audio amplifier integrated circuit is connected to the voice coil and the coil is specifically as follows: A lead of the voice coil is welded to a solder pad at the bottom of the frame, a lead of the coil is welded to the solder pad, and the audio amplifier integrated circuit is electrically connected to the solder pad.

The solder pad may be a solder pad at the bottom of a frame of the speaker.

That the audio amplifier integrated circuit determines the driver voltage or driver current of the voice coil based on the inductance value and the voltage or current may be specifically as follows: The audio amplifier integrated circuit determines the driver voltage of the voice coil based on the inductance value and the voltage; or the audio amplifier integrated circuit determines the driver current of the voice coil based on the inductance value and the current.

That the voice coil is configured to drive, based on the driver voltage or driver current, the magnetic diaphragm to vibrate may be specifically as follows: The voice coil is configured to drive, based on the driver voltage, the magnetic diaphragm to vibrate, or the voice coil is configured to drive, based on the driver current, the magnetic diaphragm to vibrate.

In this case, the audio amplifier integrated circuit of the terminal may sample the voltages or currents at the two ends of the voice coil, determine displacement of a diaphragm based on the detected inductance value, and then adjust the driver voltage of the voice coil based on the displacement of the diaphragm and the voltages at the two ends of the voice coil, or adjust the driver current of the voice coil based on the displacement of the diaphragm and the currents at the two ends of the voice coil. In this way, not only the speaker can produce a sound as loud as possible, but also the speaker is protected from damage.

In a possible implementation, the speaker further includes a front cover, a frame, and a magnet. The coil is located on an inner side of the front cover, the magnetic diaphragm is located between the coil and the voice coil, a periphery of the magnetic diaphragm is adhered to one side of the frame, the magnet is located on the other side of the frame, and one side and the other side of the frame are two opposite sides of the frame.

The magnetic diaphragm includes a diaphragm and a magnetic conductive material coated on a surface of the diaphragm.

In a possible implementation, that the audio amplifier integrated circuit is connected to the voice coil and the coil includes: the lead of the voice coil is welded to the solder pad at the bottom of the frame, the lead of the coil is welded to the solder pad, and the solder pad is electrically connected to the audio amplifier integrated circuit.

That the lead of the coil is welded to the solder pad is specifically as follows: A lead groove is disposed on the front cover and the frame of the speaker, and the lead of the coil is welded to the solder pad through the lead groove.

In a possible implementation, the audio amplifier integrated circuit includes a first detection module, a second detection module, and a driver module, where an input end of the first detection module is connected to two pins of the coil, and the first detection module is configured to measure the inductance value at the two ends of the coil;

an input end of the second detection module is connected to two pins of the voice coil, and the second detection module is configured to measure the voltage or current at the two ends of the voice coil; and an input end of the driver module is connected to an output end of the first detection module and an output end of the second detection module, and the driver module is configured to determine the driver voltage or driver current of the voice coil based on the inductance value and the voltage or current.

In a possible implementation, the first detection module includes an oscillator, a zero-crossing comparator, and a frequency measurement module, where the oscillator is connected to the coil;

the zero-crossing comparator is configured to convert a sine wave output by the oscillator into an intra-frequency square wave; and the frequency measurement module is configured to measure and output a frequency of the intra-frequency square wave.

In another possible design, the driver module is specifically configured to: calculate the inductance value of the coil based on the frequency that is of the intra-frequency square wave and that is obtained through measurement by the frequency measurement module, and a relationship between an oscillation frequency of the oscillator and an inductance value of the coil, and determine displacement of the diaphragm according to a preset correspondence between an inductance value and displacement of the diaphragm; and determine an adjusted driver voltage or driver current of the voice coil based on the displacement of the diaphragm and the voltage or current.

According to a third aspect, this application provides a speaker control method, including:

obtaining inductance value at two ends of the coil and voltage or current at two ends of the voice coil;

determining an adjusted driver voltage or driver current of the voice coil based on the inductance value and the voltage or current at the two ends of the voice coil; and outputting the adjusted driver voltage or driver current to the voice coil, so that the voice coil drives, under an action of the driver voltage or driver current, a magnetic diaphragm to vibrate.

The speaker control method may be performed by an audio amplifier integrated circuit.

According to a fourth aspect, this application provides a speaker control apparatus. The control apparatus has a function of implementing behavior of the audio amplifier integrated circuit in a terminal example in the third aspect. The function may be implemented by hardware, or may be implemented by hardware by executing corresponding software. The hardware or the software includes one or more modules corresponding to the foregoing function.

In a possible implementation, a structure of the control apparatus includes a driver unit, a first detection unit, and a second detection unit. The first detection unit is configured to measure the inductance value; the second detection unit is configured to measure voltages at two ends of the voice coil; and the driver unit is configured to: determine an adjusted driver voltage of the voice coil based on the inductance value of the voice coil and the voltages at the two ends of the voice coil, and output the adjusted driver voltage to the voice coil, so that the voice coil drives, under an action of the driver voltage, the diaphragm to vibrate.

In a possible implementation, a structure of the control apparatus includes a driver unit, a first detection unit, and a second detection unit. The first detection unit is configured to measure the inductance value; the second detection unit is configured to measure currents at two ends of the voice coil; and the driver unit is configured to: determine an adjusted driver current of the voice coil based on the inductance value of the voice coil and the currents at the two ends of the voice coil, and output the adjusted driver current to the voice coil, so that the voice coil drives, under an action of the driver current, the diaphragm to vibrate.

According to a fifth aspect, an embodiment of this application provides a computer readable storage medium, including an instruction. When the instruction is run on a computer, the computer is enabled to perform the method provided in the implementations of the fourth aspect.

According to a sixth aspect, an embodiment of this application provides a computer program product including an instruction. When the instruction is run on a computer, the computer is enabled to perform the method provided in the implementations of the fourth aspect.

In the embodiments of this application, the coil is disposed on the front cover of the speaker. When the diaphragm moves, a change in the inductance value of the coil is triggered. Then, the speaker detects the inductance value of the coil, and samples the voltages or currents at the two ends of the voice coil. The driver module of the speaker determines the displacement of the diaphragm based on the inductance value, and adjusts the driver voltage of the voice coil or adjusts the driver current of the voice coil based on the displacement of the diaphragm and the voltages or currents at the two ends of the voice coil. The driver module may calculate an amplitude of the diaphragm of the speaker based on the inductance value, and the amplitude of the diaphragm of the speaker may be controlled to not exceed a bearing range of the speaker.

DETAILED DESCRIPTION OF ILLUSTRATIVE EMBODIMENTS

The following further describes the embodiments of this application in detail with reference to accompanying drawings.

The embodiments of this application provide a speaker, a terminal, and a speaker control method, to resolve a problem that a speaker is damaged due to an increase in a gain of an audio amplifier integrated circuit of the speaker. A method and an apparatus have similar problem-resolving principles. Therefore, mutual reference may be made to implementations of the apparatus and the method, and repeated content is not described again.

In the following, some terms in this application are described, to help a person skilled in the art have a better understanding.

"Plurality of" is two or more. In addition, it should be understood that in descriptions of this application, terms such as "first" and "second" are merely used for differentiation and description, but should not be understood as an indication or an implication of relative importance or an indication or implication of an order.

Figure 1:
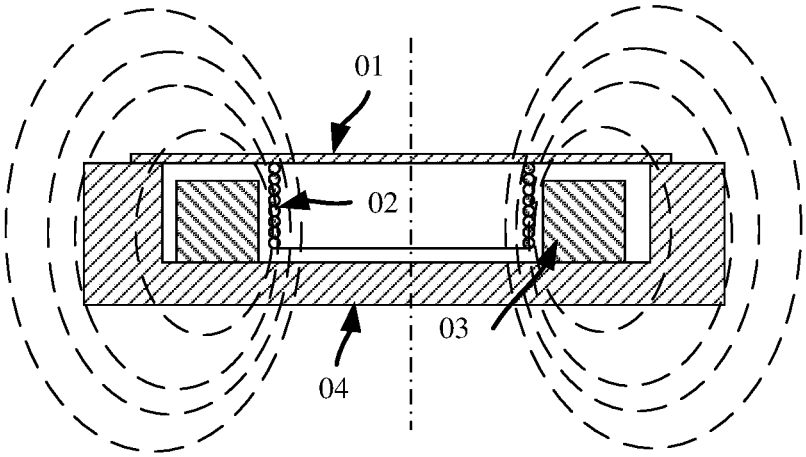
FIG. 1 is a schematic structural diagram of a moving coil speaker in the prior art.
Figure 2:
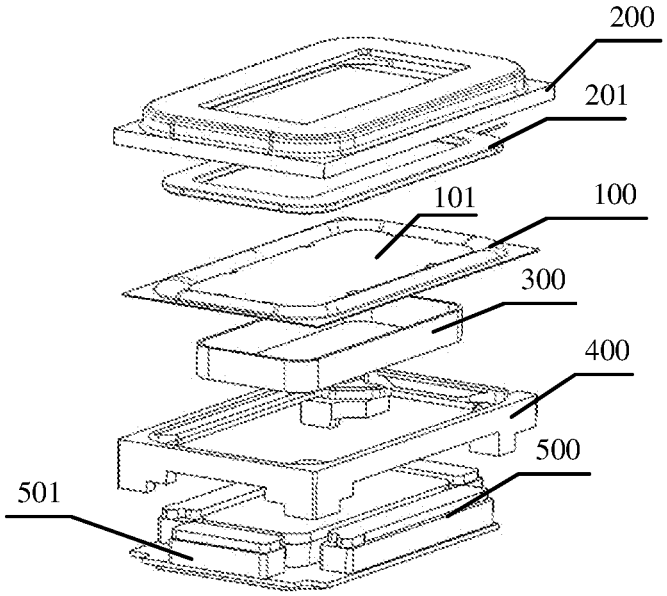
FIG. 2 is a schematic diagram of an exploded structure of a speaker according to an embodiment of this application.
Figure 3:
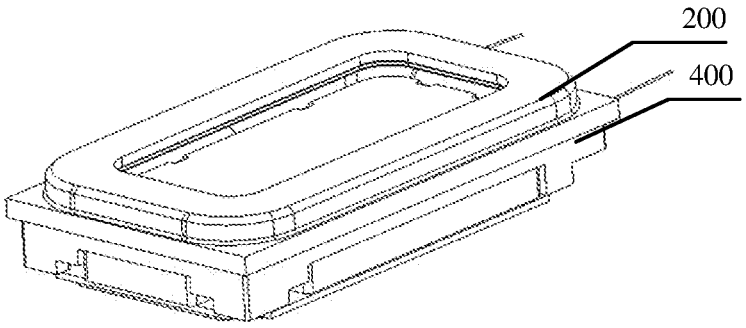
FIG. 3 and FIG. 4 are schematic diagrams of an assembly structure of a speaker according to an embodiment of this application.
Figure 4:
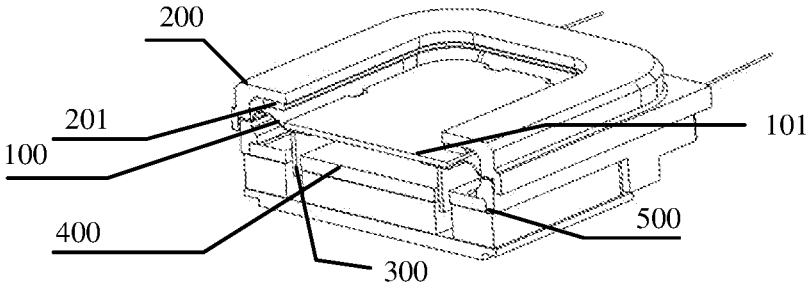

FIG. 2 is a schematic diagram of an exploded structure of a speaker according to an embodiment of this application. FIG. 3 is a schematic diagram of an assembly structure of a speaker according to an embodiment of this application. FIG. 4 is a schematic structural diagram of a transversal section of a speaker according to an embodiment of this application. The speaker includes a front cover 200, a coil 201, a magnetic diaphragm 100, a voice coil 300, a frame 400, and a magnet 500. In the speaker shown in FIG. 2, a top end of the voice coil 300 is adhered to the magnetic diaphragm 100, and leads at two ends of the voice coil 300 are welded to a solder pad at the bottom of the frame 400, so that the solder pad is electrically connected to an audio amplifier integrated circuit that drives the speaker to work. The coil 201 is disposed on an inner side of the front cover 200. A center of the magnet 500 and a center of the frame 400 coincide, and the magnet 500 and the frame 400 are adhered together. The magnetic diaphragm 100 is adhered to an upper surface of the frame 400. For example, the magnetic diaphragm 100 may be adhered to a periphery of the upper surface of the frame 400. In the speaker shown in FIG. 2 to FIG. 4, the front cover 200, the magnetic diaphragm 100, the coil 201, and the voice coil 300 each are of a rectangular structure. In addition to the rectangular structure, the front cover 200, the magnetic diaphragm 100, the coil 201, and the voice coil 300 may be of a circular structure or another irregular structure. Examples are not listed one by one herein.

The following separately describes structures or functions of components of the speaker.

Frame 400: The frame 400 plays a role of supporting the magnetic diaphragm 100 and the magnet 500. A lead groove is disposed on the front cover 200 and the frame 400 of the speaker. A lead of the coil is welded to the solder pad through the lead groove, and the solder pad may be electrically connected to the audio amplifier integrated circuit. A common frame of the speaker is usually made of a plastic or metal material. A material of the frame is not limited in this embodiment of this application.

Magnet 500: The magnet 500 includes a plurality of magnetic pieces 501. In specific implementation, in addition to a permanent magnet, an electromagnet may also be used for the magnetic piece 501. The magnet may be configured to generate a constant magnetic field with specific magnetic induction intensity in the speaker. The magnet may be made of a magnetic material such as ferrite, a neodymium magnet, or a strontium magnet. A material of the magnet is not limited in this embodiment of this application.

Magnetic diaphragm 100: The magnetic diaphragm 100 is an element that is of a moving coil speaker and that produces a sound through vibration, and is usually in a film shape. A periphery of the magnetic diaphragm 100 may be in a convex shape.

In this embodiment of this application, the magnetic diaphragm 100 is a diaphragm that is magnetic, and the diaphragm may be coated with a magnetic conductive material coating, or may be coated with a ferromagnetic material, for example, a magnetic conductive material 101 in FIG. 2. By comparison, the magnetic conductive material is lighter. Basically, adding the magnetic conductive material coating does not cause an increase in weight of the diaphragm, and therefore, vibration imbalance is not caused. Therefore, the magnetic conductive material may be used in this embodiment of this application. Main components of the magnetic conductive material coating are a granular magnetic conductive material (for example, a ferro-aluminum alloy, a ferrosilicon aluminum alloy, a ferrocobalt alloy, or soft magnetic ferrite) and an adhesive. In addition to coating, a layer of magnetic conductive material film may be evaporated and deposited on the diaphragm. In addition to cooperating in measurement of the coil to measure displacement of the diaphragm, the magnetic conductive material coating or the magnetic conductive material film further increases rigidity of the diaphragm.

Voice coil 300: In this embodiment of this application, the voice coil 300 is a coil that drives the magnetic diaphragm to vibrate to produce a sound. The leads at the two ends of the voice coil 300 are welded to the solder pad. Therefore, the voice coil 300 is connected to the audio amplifier integrated circuit of the speaker, and the audio amplifier integrated circuit applies a current to the voice coil, so that a changing magnetic field can be generated around the voice coil. Magnetic force is generated between the changing magnetic field generated by the voice coil and the constant magnetic field of the magnet, to drive the voice coil to move in the constant magnetic field. The voice coil drives the magnetic diaphragm to vibrate to produce a sound. In this embodiment of this application, the voice coil 300 may be a coil formed by winding a wire, and a material of the coil may be copper, aluminum, silver, an alloy, or the like. The voice coil 300 may also be a flexible conducting layer coil formed on the magnetic diaphragm, and a material of the flexible conducting layer coil may also be copper, aluminum, silver, an alloy, or the like. A structure and a material of the voice coil are not limited in this embodiment of this application.

Coil 201: The coil 201 is inductive. An inductance value L of the coil 201 is related to a quantity (N) of turns of the coil, a geometric size (D, such as a radius and a thickness), an air magnetic permeability (u0), a magnetic permeability (u1) of the magnetic conductive material coating on the magnetic diaphragm, and a relative distance between the magnetic diaphragm and the coil (namely, displacement z of the voice coil), and may be expressed as $$L=f(N,D,u0,u1,z),$$

In this embodiment of this application, the coil 201 may be formed by winding a wire, and a material of the coil 201 may be copper, aluminum, silver, an alloy, or the like. The coil 200 may also be a flexible conducting layer coil, and a material of the coil 201 may also be copper, aluminum, silver, an alloy, or the like. A structure and the material of the coil are not limited in this embodiment of this application. The coil may be usually fastened to the inner side of the front cover of the speaker through adhering or injection molding.

In this embodiment of this application, when the voice coil 300 drives the magnetic diaphragm 100 to vibrate up and down, a position of the magnetic diaphragm 100 relative to the front cover 200 (or the coil disposed on the front cover) changes accordingly. In this case, the magnetic diaphragm 100 is magnetic, and therefore, is equivalent to an "iron core" in an inductance principle. Because a position of the "iron core" relative to the coil changes, the inductance value L of the coil 201 changes. The quantity of turns of the coil, the geometrical size, the air permeability, and the magnetic permeability of the magnetic conductive material coating on the magnetic diaphragm are fixed after the speaker is manufactured. Therefore, a change in the inductance value of the coil is related to a relative distance z between the magnetic diaphragm and the coil (L=f(z)). When the magnetic diaphragm 100 moves towards the coil 201, z decreases, and the inductance value L increases. When the magnetic diaphragm 100 is away from the coil 201, z increases, and the inductance value L decreases.

Compared with conventional measurement of an amplitude of a magnetic diaphragm according to a capacitance principle, measurement of the amplitude of the magnetic diaphragm in this embodiment of this application is more precise. Capacitance of a common parallel-plate capacitor is $C=\varepsilon S/d$, where c is a dielectric constant of a medium between plates, s is an area of the plates, and d is a distance between the plates. The capacitance and the distance fulfill an inversely proportional function. Therefore, when the distance is very large, the capacitance does not change greatly. However, in this embodiment of this application, inductance and the distance meet the formula L=f(z), and the inductance and the distance are in a linear relationship. Therefore, when the distance increases, it is clearly that the inductance decreases. Therefore, in this embodiment of this application, precision of measuring the amplitude according to the inductance principle is improved.

Figure 5:
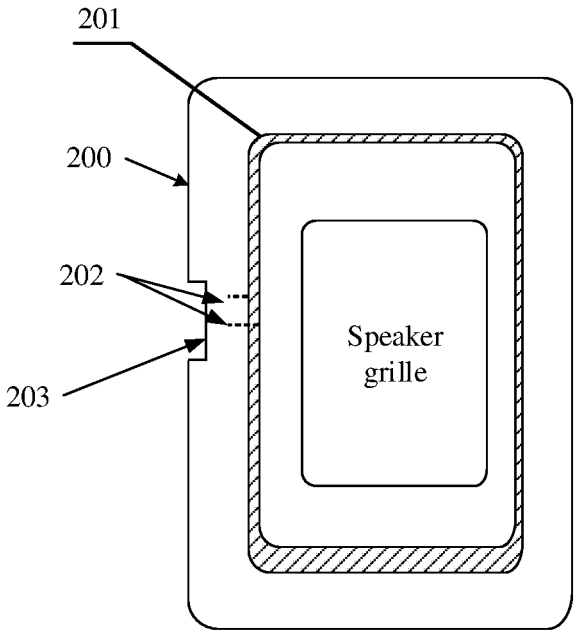
FIG. 5 is a schematic structural diagram of a top view of a front cover of a speaker according to an embodiment of this application.
Figure 6:
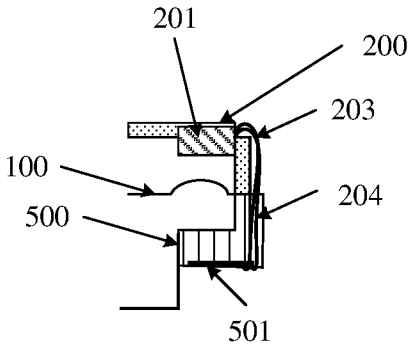
FIG. 6 is a schematic structural diagram of a partial cross section of a speaker according to an embodiment of this application.

In this embodiment of this application, FIG. 5 is a schematic structural diagram of a top view of a front cover of a speaker according to an embodiment of this application. A coil 201 that is wound is adhered to a position of a lead groove on the inner side of the front cover 200 of the speaker. The coil 201 is provided with two pins 202. FIG. 6 is a schematic diagram of an assembly structure of a coil of a speaker according to an embodiment of this application. A lead groove 203 is made on the front cover 200 of the speaker and the frame, then two leads of the coil are welded to the solder pad at the bottom of the frame through the lead groove 203, and a relatively large contact surface of the solder pad at the bottom of the frame may be reserved for connecting to the audio amplifier integrated circuit of the speaker.

Figure 7:
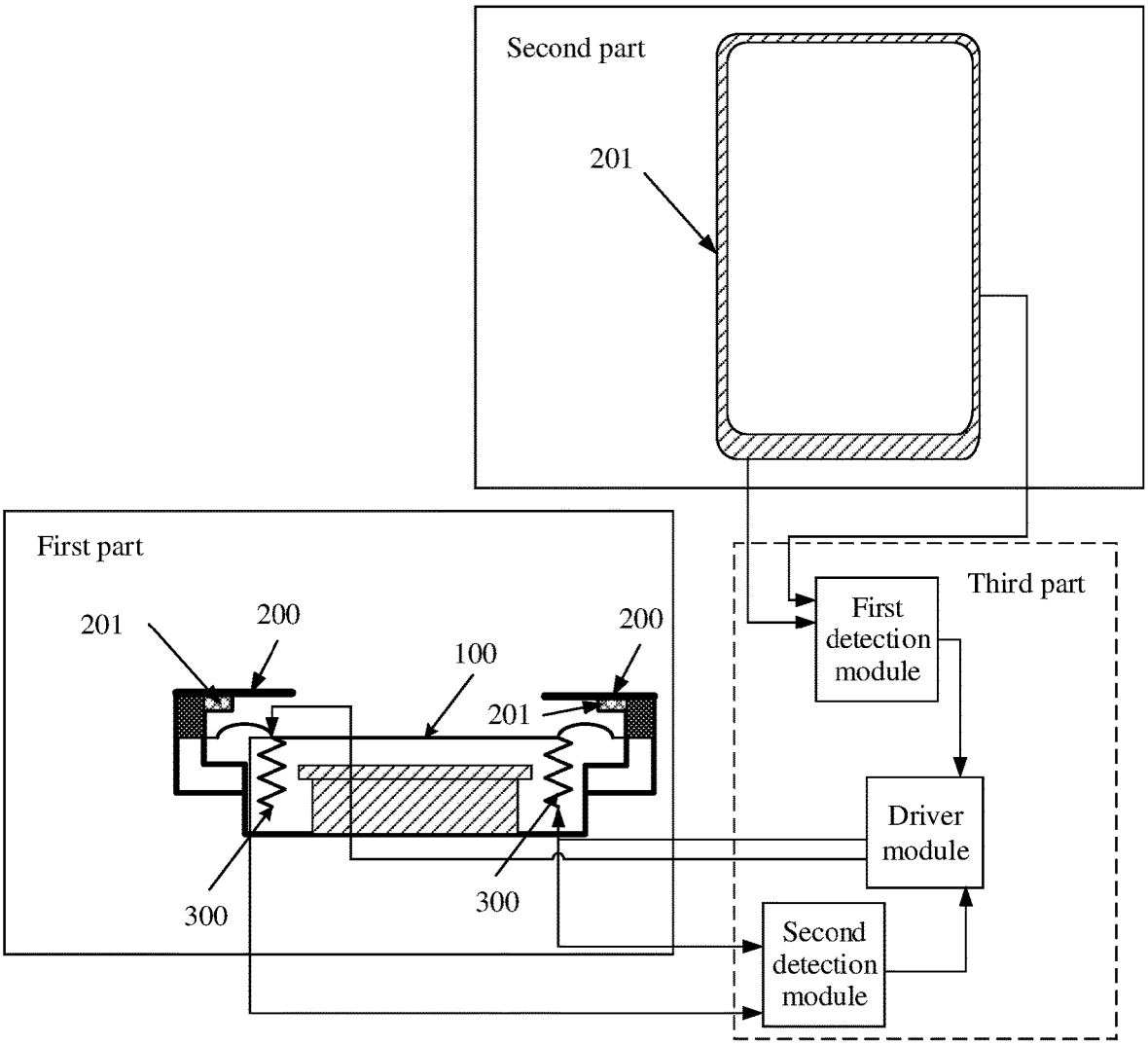
FIG. 7 is a schematic structural diagram of another terminal including a speaker according to an embodiment of this application.

Based on the foregoing speaker structure, an embodiment of this application provides a schematic structural diagram of a terminal including the foregoing speaker. In FIG. 7, a first part is a schematic structural diagram of a cross section of the speaker, a second part is a schematic structural diagram of a top view of the coil 201 of the speaker, and a third part is the audio amplifier integrated circuit of the speaker, and includes a first detection module, a second detection module, and a driver module.

In this embodiment of this application, the first detection module of the speaker samples an inductance value of the coil, and the second detection module of the speaker samples voltage or current at two ends of the voice coil. The driver module of the speaker determines displacement of the magnetic diaphragm based on the inductance value detected by the detection module, and adjusts a driver voltage of the voice coil or adjusts a driver current of the voice coil based on the displacement of the magnetic diaphragm and the voltage or current at the two ends of the voice coil. The driver module can calculate the amplitude of the magnetic diaphragm of the speaker based on the inductance value. Therefore, the amplitude of the magnetic diaphragm of the speaker may be controlled not to exceed a bearing range of the speaker. In addition, the driver module may calculate a temperature of the voice coil of the speaker based on the voltage or current. Therefore, the driver voltage of the voice coil or the driver current of the voice coil may be adjusted, to control the temperature of the voice coil of the speaker not to exceed the bearing range of the speaker. In this way, control precision of the driver module is improved. Therefore, an available amplitude of the speaker may be used to a maximum extend, so that the speaker produces a sound as loud as possible, and damage to the speaker can be avoided.

Specifically, in this embodiment of this application, the two pins of the coil 201 are connected to an input end of the first detection module, the two ends of the voice coil 300 are connected to an input end of the second detection module, and the first detection module and the second detection module are connected to the driver module. The first detection module is mainly configured to detect the inductance value L at the two ends of the coil. The second detection module is mainly configured to detect the voltage or current at the two ends of the voice coil. The second detection module may detect the voltage or current at the two ends of the voice coil periodically or in real time. The driver module may adjust the driver voltage or driver current of the voice coil based on detection results of the first detection module and the second detection module.

The voice coil 300 is connected to the driver module of the speaker, and the driver module inputs a driver voltage or driver current to the voice coil 300, so that a changing magnetic field is generated around the voice coil 300. Magnetic force is generated between the changing magnetic field generated by the voice coil 300 and the constant magnetic field of the magnet, to drive the voice coil 300 to move in the constant magnetic field. The voice coil 300 drives the magnetic diaphragm 100 to vibrate to produce a sound. When the magnetic diaphragm 100 vibrates, a relative distance between the magnetic diaphragm 100 and the coil 201 on the front cover 200 changes. A relationship between the relative distance z and the inductance value L of the coil is L=f(z). When the magnetic diaphragm 100 moves towards the coil, z decreases, and the inductance value L increases. When the magnetic diaphragm is away from the coil, z increases, and the inductance value L decreases.

When the driver module receives the detection result of the first detection module, namely, the inductance value L, displacement Z of the magnetic diaphragm, namely, the amplitude of the magnetic diaphragm, may be determined according to L=f(z). The driver module may analyze and integrate the displacement Z of the magnetic diaphragm and the voltage or current at the two ends of the voice coil, to adjust the driver voltage or driver current of the voice coil. In this way, the speaker can produce a sound as loud as possible, and the speaker can be protected from being damaged.

A policy of adjusting the driver voltage is usually performing adjustment based on factors such as displacement, a voltage of the coil, and a current of the coil. In Manner 1, the driver module may calculate n values of displacement (amplitudes of the magnetic diaphragm) based on detection results of inductance values within a period of time, then determine a largest value in the n values of displacement, or calculate an average value of the n values of displacement, and compare the largest value or the average value with a specified threshold (for example, 0.5 mm). When a determining result is that the largest value or the average value is greater than the specified threshold, the driver voltage or driver current of the voice coil is decreased. In Manner 2, with reference to Manner 1, the driver module further determines whether an average value of a plurality of voltages of the voice coil is greater than a specific threshold (for example, 4V), or whether an average value of a plurality of currents of the voice coil exceeds a specific threshold (for example, 500 mA). When a determining result is that the average value of the plurality of voltages exceeds the threshold or the average value of the plurality of currents exceeds the threshold, the driver voltage or driver current of the voice coil is decreased.

Specifically, description may be further provided in two scenarios.

Scenario 1

When the driver voltage is lower than a threshold (the threshold is related to a model of the speaker), there is a very small probability that the speaker is damaged. In this case, the driver voltage or driver current of the voice coil may be adjusted based on only the voltage or current of the voice coil, to reduce power consumption. In this way, the voice coil can still be controlled and protected.

Scenario 2

When the driver voltage is greater than a threshold (the threshold is related to a model of the speaker), a probability that the speaker is damaged increases. To facilitate maximum performance of the speaker, the speaker is controlled and protected by integrating measurement of displacement of the magnetic diaphragm of the voice coil and the driver voltage and driver current of the voice coil.

Figure 8:
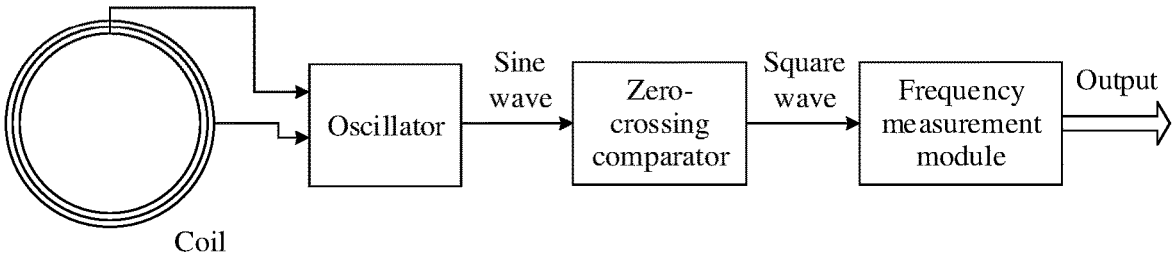
FIG. 8 is a schematic structural diagram of composition of a first detection module according to an embodiment of this application.

In specific implementation, the first detection module may include an oscillator, a zero-crossing comparator, and a frequency measurement module, as shown in FIG. 8. The two ends of the coil are connected to the oscillator. The zero-crossing comparator is configured to convert a sine wave output by the oscillator into an intra-frequency square wave. The frequency measurement module is configured to measure and output a frequency of the intra-frequency square wave. Usually, the square wave frequency is measured in a method such as a counting method, and a DSP in the driver module calculates an inductance value of the coil based on the square wave frequency obtained through measurement and a relationship between an oscillation frequency of the oscillator and an inductance value, and calculates displacement of the diaphragm based on a relationship between the inductance value and the displacement of the magnetic diaphragm.

Herein, there is a determined correspondence between the oscillation frequency of the oscillator and the inductance value L, as shown in formula [1].

$$f = \frac{1}{2\pi\sqrt{LC}} \qquad \text{formula [1]}$$

Herein, L is the inductance value of the coil, C is a capacitance value, and f is the oscillation frequency of the oscillator.

Figure 9:
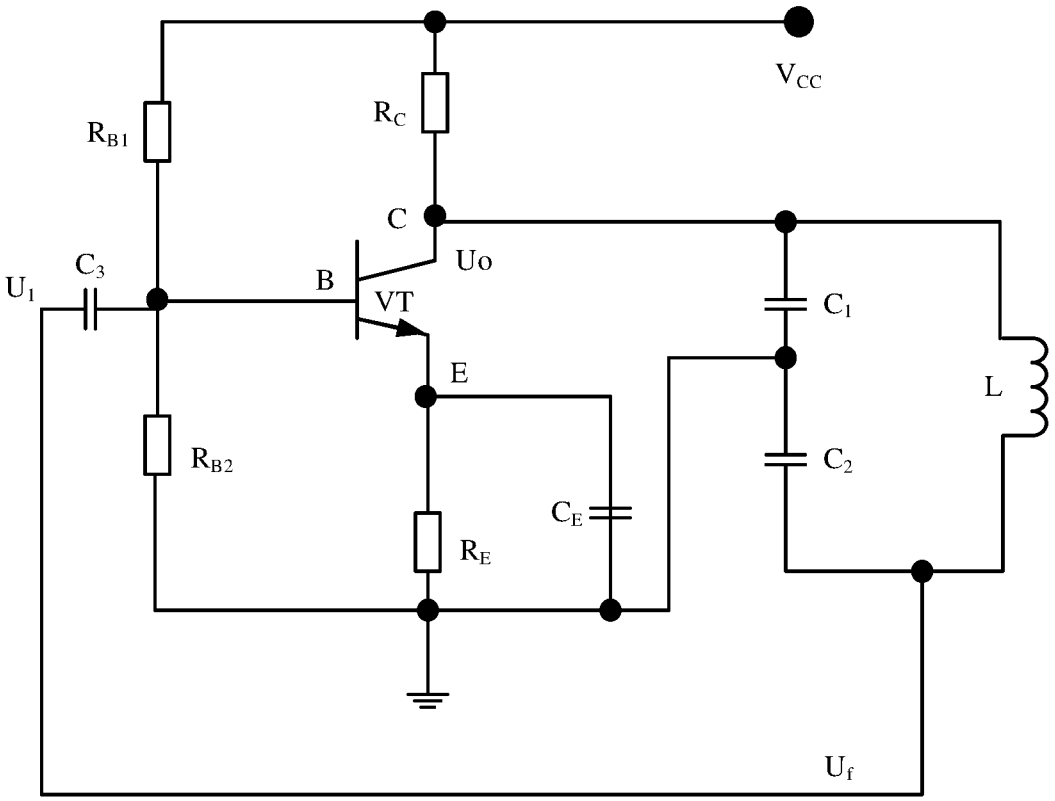
FIG. 9 is a schematic diagram of a circuit principle of an oscillator according to an embodiment of this application.

The oscillator is constructed according to a three-point capacitance principle. Referring to FIG. 9, two ends of a coil L are respectively connected to two ends of an oscillator, and an output voltage of the oscillator is a sine voltage U0. In formula [1], C is a capacitance value obtained after C1 and C2 are connected in series.

In addition, the second detection module may be a voltage detection circuit or a current detection circuit that is formed based on a volt ampere principle, and the driver module may include a digital signal processor (DSP) and a power amplifier. The DSP is configured to calculate the detection result of the first detection module to determine the displacement, and then calculate the adjusted driver voltage or driver current based on a calculation model. The power amplifier is configured to amplify an analog signal.

Figure 10:
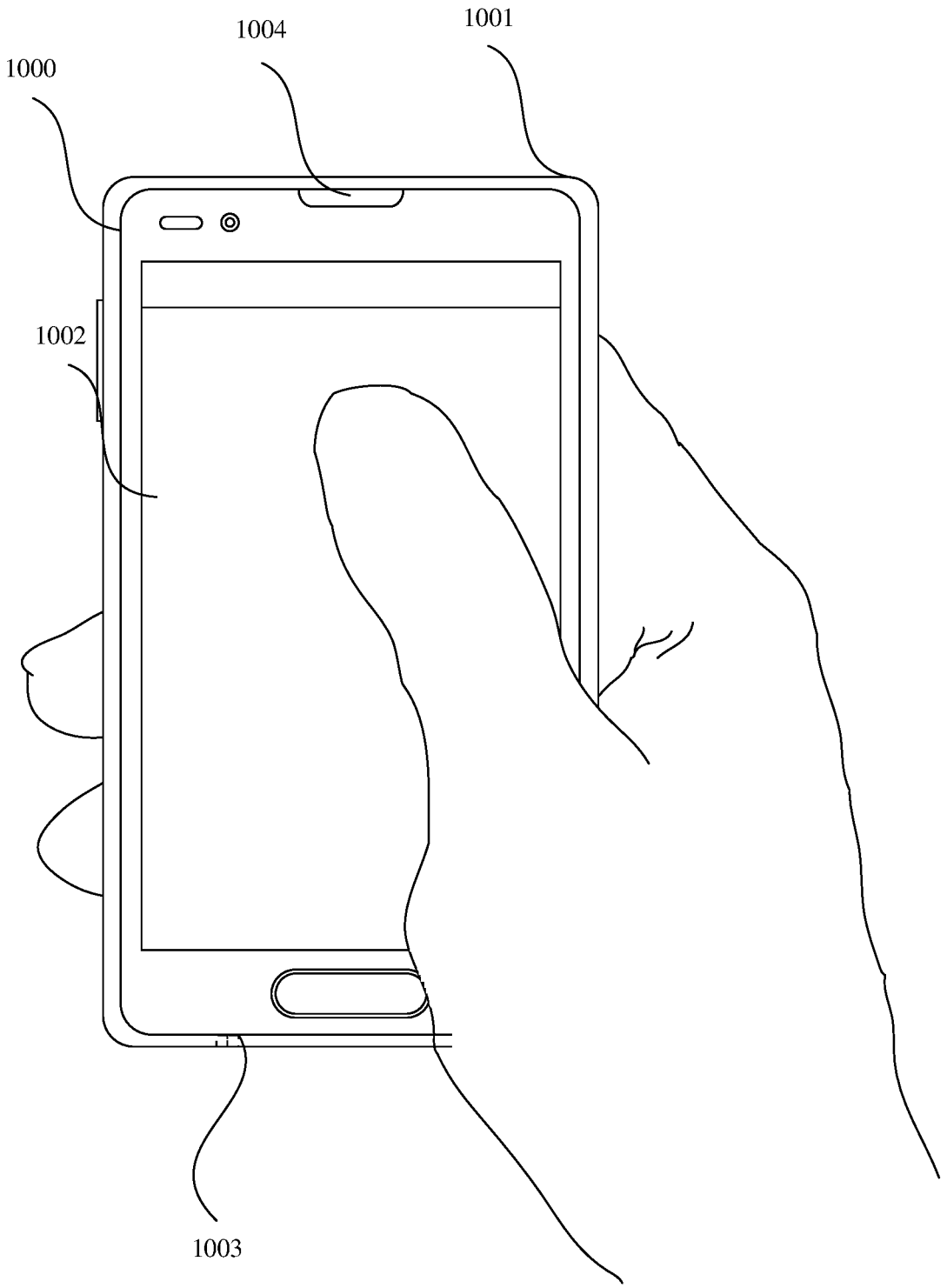
FIG. 10 is a schematic structural diagram of composition of a mobile phone according to an embodiment of this application.

The speaker provided in this embodiment of the present invention is also applicable to a mobile phone shown in FIG. 10. The following first briefly describes specific structural composition of the mobile phone.

FIG. 10 is a schematic structural diagram of hardware of a mobile phone according to an embodiment of this application. As shown in FIG. 10, a mobile phone 1000 includes a housing 1001, a display 1002, a microphone 1003, and a speaker 1004.

The display 1002 is configured to display information entered by a user or information provided for the user, various menu screens of the mobile phone 1000, and the like. Optionally, a display panel of the display may be a liquid crystal display (liquid crystal display, LCD), an OLED. (organic light-emitting diode, organic light-emitting diode), or the like.

The speaker 1004 may transmit a voice to the user during a call, and may further transmit a sound associated with a music file played by a music player running on the mobile phone 1000. The microphone 1003 is configured to pick up a user voice.

Figure 11:
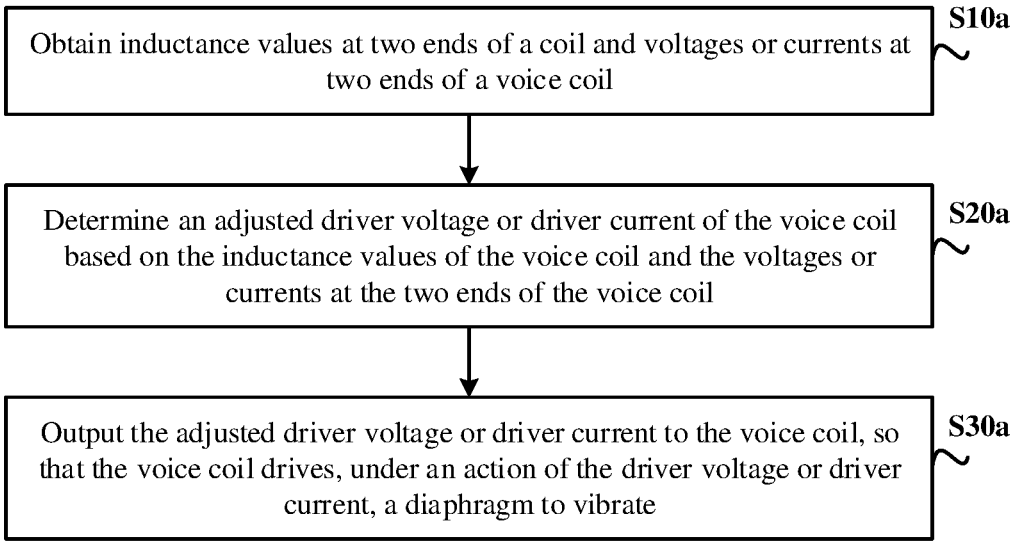
FIG. 11 is a schematic flowchart of a speaker control method according to an embodiment of this application.

An embodiment of this application further provides a speaker control method. The method is applicable to the speaker provided in the foregoing embodiment, and can measure and control an amplitude of the speaker. Referring to FIG. 11, an audio amplifier integrated circuit may perform the method. The audio amplifier integrated circuit includes a first detection module, a second detection module, and a driver module. The method includes the following steps:

Step S10*a*: Obtain inductance value at two ends of the coil and voltage at two ends of the voice coil.

Step S20*a*: Determine an adjusted driver voltage or driver current of the voice coil based on the inductance value of the voice coil and the voltage at the two ends of the voice coil.

Step S30*a*: Output the adjusted driver voltage or driver current to the voice coil, so that the voice coil drives, under an action of the driver voltage, the magnetic diaphragm to vibrate.

To be specific, the audio amplifier integrated circuit may analyze and integrate displacement Z of the magnetic diaphragm and the voltage or current at the two ends of the voice coil, to adjust the driver voltage or driver current. In this way, the speaker can produce a sound as loud as possible, and the speaker can be protected from being damaged.

A policy of adjusting the driver voltage is usually performing adjustment based on factors such as displacement, a voltage of the coil, and a current of the coil. In Manner 1, the driver module may calculate n values of displacement (amplitudes of the magnetic diaphragm) based on detection results of inductance values within a period of time, then determine a largest value in the n values of displacement, or calculate an average value of the n values of displacement, and compare the largest value or the average value with a specified threshold (for example, 0.5 mm). When a determining result is that the largest value or the average value is greater than the specified threshold, the driver voltage or driver current of the voice coil is decreased. In Manner 2, with reference to Manner 1, the driver module further determines whether an average value of a plurality of voltages of the voice coil is greater than a specific threshold (for example, 4V), or whether an average value of a plurality of currents of the voice coil exceeds a specific threshold (for example, 500 mA). When a determining result is that the average value of the plurality of voltages exceeds the threshold or the average value of the plurality of currents exceeds the threshold, the driver voltage or driver current of the voice coil is decreased.

Specifically, description may be further provided in two scenarios.

Scenario 1

When the driver voltage is lower than a threshold (the threshold is related to a model of the speaker), there is a very small probability that the speaker is damaged. In this case, to reduce power consumption, the amplifier integrated circuit adjusts the driver voltage of the voice coil based on only the driver voltage and current of the voice coil, to control and protect the voice coil.

Scenario 2

When the driver voltage is greater than a threshold (the threshold is related to a model of the speaker), a probability that the speaker is damaged increases. To facilitate maximum performance of the speaker, the amplifier integrated circuit controls and protects the speaker by integrating measurement of displacement of the magnetic diaphragm of the voice coil and the driver voltage and driver current of the voice coil.

A process and a principle of the speaker control method provided in this embodiment of this application are described below with reference to a specific application scenario.

Figure 12:
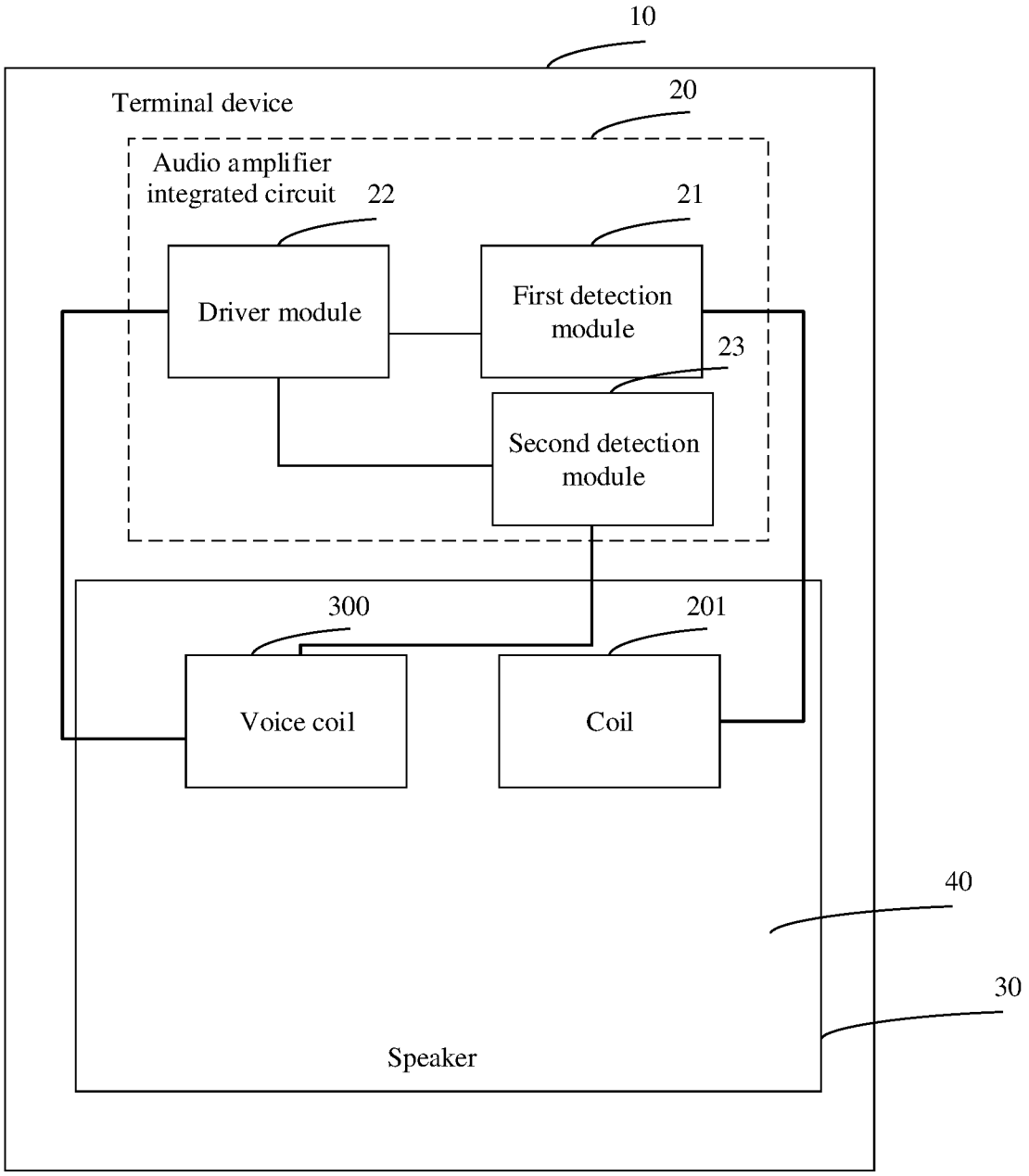
FIG. 12 is a schematic structural diagram of a terminal device according to an embodiment of this application.

In this application scenario, a speaker is disposed on a terminal device, and the terminal device is a mobile phone. In addition, the terminal device may be a tablet, a notebook computer, or the like. Referring to FIG. 2, a structure of the speaker includes a front cover, a coil disposed on the front cover, a magnetic diaphragm, a voice coil, a magnet, a frame, and the like. For a schematic structural diagram of the terminal device, refer to FIG. 12. A terminal device 10 includes an audio amplifier integrated circuit 20 and a speaker 30, and both a coil 201 and a voice coil 300 in the speaker 40 are connected to the audio amplifier integrated circuit 20. The audio amplifier integrated circuit 20 is configured to implement functions of a driver module, a first detection module, and a second detection module of the speaker 30.

The audio amplifier integrated circuit 20 includes a driver module 22, a first detection module 21, and a second detection module 23. The voice coil 300 is connected to the driver module 22, the voice coil 300 is connected to the second detection module 23, and the coil 201 is connected to the first detection module 21.

Figure 13:
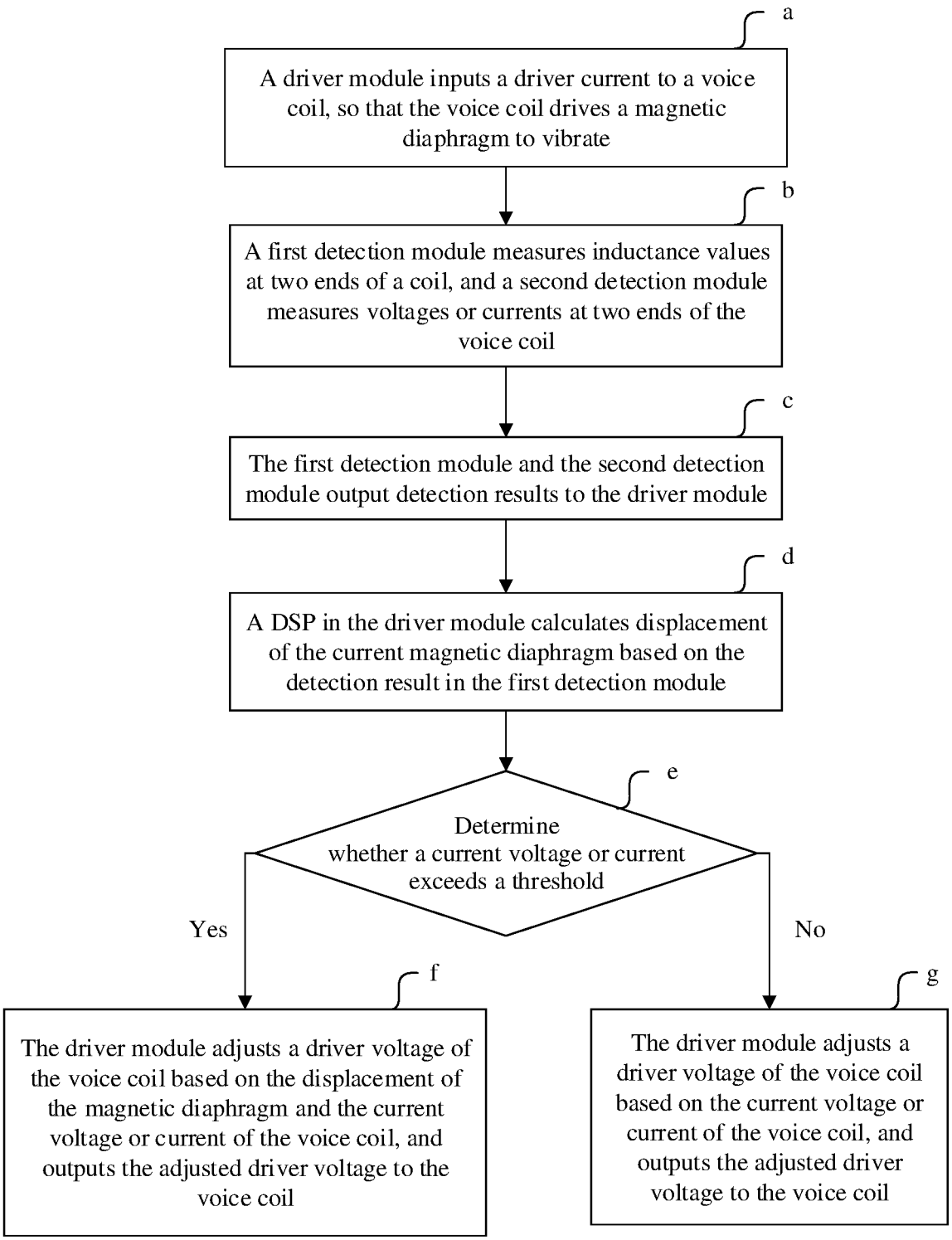
FIG. 13 is a schematic flowchart of another speaker control method according to an embodiment of this application.

As shown in FIG. 13, an implementation process of the speaker control method includes the following steps:

Step a: The driver module 22 inputs a driver current to the voice coil 300, so that the voice coil 300 drives the magnetic diaphragm to vibrate.

Step b: The first detection module 21 measures inductance value at two ends of the coil 201, and the second detection module 23 measures voltage or current at two ends of the voice coil 300. For example, the second detection module 23 may measure real-time voltage or real-time current at the two ends of the voice coil 300.

Step c: The first detection module 21 and the second detection module 23 output detection results to the driver module 22.

Step d: A DSP in the driver module 22 calculates displacement of the current magnetic diaphragm based on the detection result in the first detection module 21.

Step e: The driver module 22 determines whether a current voltage or current exceeds a threshold, and if the current voltage or current exceeds the threshold, performs step f; or if the current voltage or current does not exceed the threshold, performs step g.

Step f: The driver module 22 adjusts a driver voltage of the voice coil based on the displacement of the magnetic diaphragm and the current voltage or current of the voice coil, and outputs the adjusted driver voltage to the voice coil.

Step f: The driver module 22 adjusts a driver voltage of the voice coil 300 based on the current voltage or current of the voice coil 300, and outputs the adjusted driver voltage to the voice coil 300.

It can be learned that according to the foregoing control method, there is little impact on structural complexity and costs of the speaker, weight of the magnetic diaphragm is not greatly increased, and vibration imbalance is not caused. Therefore, impact on electro-acoustic performance of the speaker is very small. In addition, designs of circuit parts of the driver module and the detection module are relatively simple and easy to implement.

Figure 14:
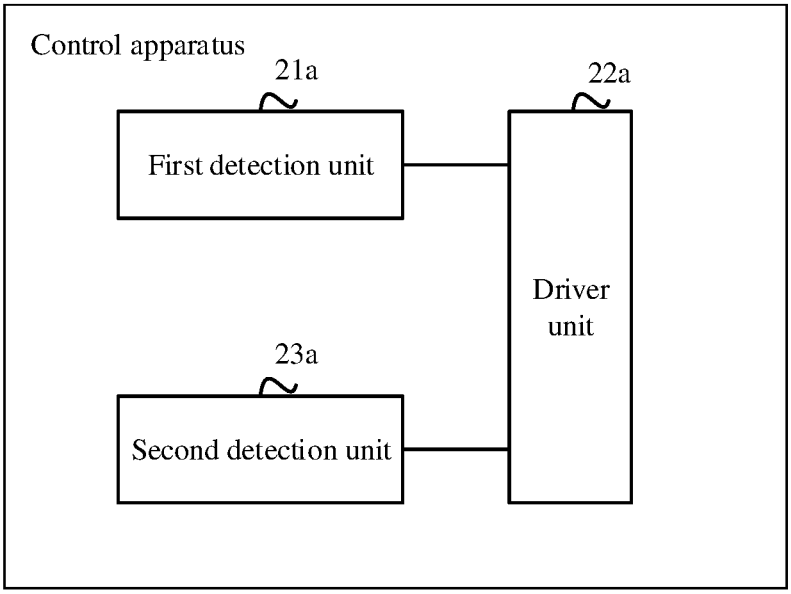
FIG. 14 is a schematic structural diagram of a speaker control apparatus according to an embodiment of this application.

An embodiment of this application further provides a speaker control apparatus. As shown in FIG. 14, the control apparatus includes a driver unit 22*a*, a first detection unit 21*a*, and a second detection unit 22*a*. The control apparatus may be usually implemented by using hardware or a combination of software and hardware. For example, the driver unit may be a chip, the chip is connected to a memory, and the memory stores a computer program. The chip is configured to read and execute the computer program stored in the memory. The first detection unit may be implemented by using a combination of software and hardware, or may be a circuit module including an oscillator, a zero-crossing comparator, and a frequency measurement module. The second detection unit may be implemented by using a combination of software and hardware, or may be implemented by using a circuit for detecting a voltage or current. For specific functions of the driver unit, the first detection unit, and the second detection unit, refer to the driver module, the first detection module, and the second detection module in the method procedure in FIG. 12. Details are not described herein again.

It should be noted that, in the embodiments of this application, division into units is an example, and is merely a logical function division. In actual implementation, another division manner may be used. Function units in the embodiments of this application may be integrated into one processing unit, or each of the units may exist alone physically, or two or more units are integrated into one unit. The integrated unit may be implemented in a form of hardware, or may be implemented in a form of a combination of software and a hardware function unit.

When the integrated unit is implemented in the form of a combination of software and hardware, the software is used to implement a corresponding function. When the function may be sold or used as an independent product, the function may be stored in a computer readable storage medium. Based on such an understanding, the technical solutions of this application essentially, or the part contributing to the prior art, or all or some of the technical solutions may be implemented in the form of a software product. The computer software product is stored in a storage medium and includes several instructions for instructing a computer device (which may be a personal computer, a server, or a network device) or a processor (processor) to perform all or some of the steps of the methods described in the embodiments of this application. The foregoing storage medium includes: any medium that can store program code, such as a USB flash drive, a removable hard disk, a read-only memory (Read-Only Memory, ROM), a magnetic disk, or an optical disc.

Based on the foregoing embodiments, an embodiment of this application provides a computer readable storage medium, including an instruction. When the instruction is run on a computer, the computer is enabled to perform the speaker control method provided in the foregoing embodiments.

Based on the foregoing embodiments, this application provides a computer program product including an instruction. When the computer program product is run on a computer, the computer is enabled to perform the speaker control method provided in the foregoing embodiments.

An embodiment of this application further provides a terminal, including the speaker provided in the foregoing embodiments. In specific implementation, the terminal may be a terminal device such as a mobile phone, a tablet, or a notebook computer, and one or more speakers may be disposed in the terminal.

A person skilled in the art should understand that the embodiments of this application may be provided as a method, an apparatus, or a computer program product. Therefore, the embodiments of this application may be implemented by using hardware or a combination of software and hardware. Moreover, this application may use a form of a computer program product that is implemented on one or more computer-usable storage media (including but not limited to a disk memory, a CD-ROM, an optical memory, and the like) that include computer usable program code.

Definitely, a person skilled in the art can make various modifications and variations to embodiments of this application without departing from the scope of this application. This application is intended to cover these modifications and variations provided that they fall within the scope of protection defined by the following claims and their equivalent technologies.

What is claimed is:

1. A terminal, comprising:

a speaker, comprising a coil, a magnetic diaphragm, and a voice coil; and an audio amplifier integrated circuit, connected to the voice coil and the coil, wherein the audio amplifier integrated circuit comprises a first detection circuit having an input end connected to two pins of the coil, wherein the audio amplifier integrated circuit further comprises a second detection circuit having an input end connected to a first pin and a second pin of the voice coil, wherein the audio amplifier integrated circuit further comprises a driver circuit having an input end connected to an output end of the first detection circuit and connected to an output end of the second detection circuit, and wherein the audio amplifier integrated circuit is configured to:

measure, using the second detection circuit, a voltage or current across a first end and a second end of the voice coil; and measure, using the first detection circuit, an inductance value, across a first end and second end of the coil, as affected by the magnetic diaphragm;

wherein the driver circuit is configured to determine a driver voltage or driver current of the voice coil based on the voltage or the current, and based on the inductance value; and wherein the voice coil is configured to drive, based on the driver voltage or the driver current, the magnetic diaphragm to vibrate.

2. The terminal according to claim 1, wherein:

the speaker further comprises a front cover, a frame, and a magnet; and the coil is located on an inner side of the front cover, the magnetic diaphragm is located between the coil and the voice coil, a periphery of the magnetic diaphragm is adhered to a first side of the frame, the magnet is located on a second side of the frame, and the first side and the second side are opposite sides of the frame.

3. The terminal according to claim 1, wherein the magnetic diaphragm comprises:

a diaphragm; and a magnetic conductive material coated on a surface of the diaphragm.

4. The terminal according to claim 1, wherein the audio amplifier integrated circuit being connected to the voice coil and the coil comprises:

a lead of the voice coil being welded to a solder pad at a bottom of a frame, a lead of the coil being welded to the solder pad, and the solder pad being electrically connected to the audio amplifier integrated circuit.

5. The terminal according to claim 1, wherein the terminal is a mobile phone.

6. The terminal according to claim 1, wherein the terminal is a tablet.

7. The terminal according to claim 1, wherein the terminal is a notebook computer.

8. The terminal according to claim 1, wherein the second detection circuit is configured to measure the voltage at the first end of the voice coil and the second end of the voice coil, and the driver circuit is configured to determine the driver voltage of the voice coil based on the voltage and the inductance value.

9. The terminal according to claim 1, wherein the second detection circuit is configured to measure the current at the first end of the voice coil and the second end of the voice coil, and the driver circuit is configured to determine the driver current of the voice coil based on the current and the inductance value.

10. A speaker, comprising:

a front cover;

a coil, located on an inner side of the front cover;

a frame;

a magnet;

a magnetic diaphragm spaced, with respect to the coil, to act as a core for the coil and to affect inductance of the coil as the magnetic diaphragm is moved;

a voice coil, wherein the magnetic diaphragm is located between the coil and the voice coil, a periphery of the magnetic diaphragm is adhered to a first side of the frame, the magnet is located on a second side of the frame, the first side and the second side of the frame are opposite sides of the frame, and the voice coil is configured to drive the magnetic diaphragm to vibrate; and an audio amplifier integrated circuit comprising:

a first detection circuit having an input end connected to two pins of the coil, and having circuitry for measuring an inductance value, across a first end and a second end of the coil, of the inductance of the coil as affected by the magnetic diaphragm;

a second detection circuit having an input end connected to a first pin of the voice coil and a second pin of the voice coil, and having circuitry for measuring a voltage or current across a first end and a second end of the voice coil; and a driver circuit having an input end connected to an output end of the first detection circuit and connected to an output end of the second detection circuit, and having circuitry for determining a driver voltage or driver current of the voice coil based on the voltage or current, and based on the inductance value.

11. The speaker according to claim 10, wherein the magnetic diaphragm comprises:

a diaphragm; and a magnetic conductive material coated on a surface of the diaphragm.

12. The speaker according to claim 10, wherein leads at a first end of the voice coil and a second end of the voice coil are welded to a solder pad at a bottom of the frame, a lead of the coil is welded to the solder pad, and the solder pad is electrically connected to the audio amplifier integrated circuit.

13. The speaker according to claim 10, wherein is speaker is comprised in a mobile phone.

14. The speaker according to claim 10, wherein is speaker is comprised in a tablet.

15. The speaker according to claim 10, wherein is speaker is comprised in a notebook computer.

16. A method, comprising:

obtaining an inductance value at a first end of a coil and a second end of the coil by measuring, using a first detection circuit that is of an audio amplifier integrated circuit of a speaker and that has an input end connected to two pins of the coil, the inductance value, across the first end and second end of the coil, as affected by a magnetic diaphragm of the speaker;

obtaining a voltage or a current at a first end of a voice coil and a second end of a voice coil by measuring, using a second detection circuit that is of the audio amplifier integrated circuit and that has an input end connected to a first pin of the voice coil and a second pin of the voice coil, a voltage or current across the first end and the second end of the voice coil;

determining, by a driver circuit having an input end connected to an output end of the first detection circuit and connected to an output end of the second detection circuit, an adjusted driver voltage or an adjusted driver current of the voice coil based on the voltage or current, and based on the inductance value; and outputting the adjusted driver voltage or the adjusted driver current to the voice coil, causing the voice coil to drive, under an action of the adjusted driver voltage or the adjusted driver current, the magnetic diaphragm to vibrate.

17. The method according to claim 16, wherein the magnetic diaphragm comprises a diaphragm and a magnetic conductive material coated on a surface of the diaphragm.

* * * * *